US011199315B2

(12) United States Patent
Duckworth et al.

(10) Patent No.: US 11,199,315 B2
(45) Date of Patent: Dec. 14, 2021

(54) AREA LUMINAIRE

(71) Applicant: Hubbell Incorporated, Shelton, CT (US)

(72) Inventors: Jason Duckworth, Simpsonville, SC (US); Mark Elmore, Easley, SC (US); John Andrews, Simpsonville, SC (US)

(73) Assignee: Hubbell Incorporated, Shelton, CT (US)

( * ) Notice: Subject to any disclaimer, the term of this patent is extended or adjusted under 35 U.S.C. 154(b) by 105 days.

(21) Appl. No.: 16/377,718

(22) Filed: Apr. 8, 2019

(65) Prior Publication Data

US 2019/0234591 A1 Aug. 1, 2019

Related U.S. Application Data

(62) Division of application No. 15/065,360, filed on Mar. 9, 2016, now Pat. No. 10,260,718.

(60) Provisional application No. 62/155,156, filed on Apr. 30, 2015.

(51) Int. Cl.

| | |
|---|---|
| ***F21V 21/108*** | (2006.01) |
| ***F21V 23/00*** | (2015.01) |
| ***F21V 29/76*** | (2015.01) |
| *F21V 31/00* | (2006.01) |
| *F21V 21/14* | (2006.01) |
| *F21W 131/103* | (2006.01) |
| *F21W 131/10* | (2006.01) |

(52) U.S. Cl.

CPC ..... *F21V 21/108* (2013.01); *F21V 23/009* (2013.01); *F21V 29/763* (2015.01); *F21V 21/14* (2013.01); *F21V 31/005* (2013.01); *F21W 2131/10* (2013.01); *F21W 2131/103* (2013.01)

(58) Field of Classification Search

CPC ..... F21V 29/777; F21V 29/773; F21V 29/74–767

See application file for complete search history.

(56) References Cited

U.S. PATENT DOCUMENTS

| | | | | |
|---|---|---|---|---|
| 4,188,658 | A * | 2/1980 | Aron | F16B 2/246 248/214 |
| D391,659 | S | 3/1998 | Gaskins | |
| D556,935 | S | 12/2007 | Quioque | |
| D612,090 | S | 3/2010 | Yu | |
| D634,878 | S | 3/2011 | Guercio | |
| 8,029,151 | B2 | 10/2011 | Butler | |
| D652,557 | S | 1/2012 | Boissevain | |
| D652,978 | S | 1/2012 | Boissevain | |
| D660,496 | S | 5/2012 | Akdag | |
| D670,021 | S | 10/2012 | Ahrari | |
| D672,492 | S | 12/2012 | Butler | |
| D674,950 | S | 1/2013 | Lueken | |
| 8,360,606 | B2 * | 1/2013 | Takei | F21V 19/004 362/249.01 |

(Continued)

*Primary Examiner* — Julie A Bannan

(74) *Attorney, Agent, or Firm* — Michael Best & Friedrich LLP

(57) ABSTRACT

A luminaire includes a housing having a top wall and a sidewall. A first fin extends from the top wall and a second fin extends from the side wall. A light emitter assembly having a heat sink includes a third fin extending from the heat skink configured to mate with the first and second fins. The luminaire can also include a light emitter assembly that can be selectively connected to the housing in multiple orientations.

20 Claims, 13 Drawing Sheets

(56) References Cited

U.S. PATENT DOCUMENTS

| | | | | |
|---|---|---|---|---|
| D680,258 | S | 4/2013 | Ahrari | |
| D680,259 | S | 4/2013 | Ahrari | |
| D680,676 | S | 4/2013 | Boyer | |
| D688,404 | S | 8/2013 | Boissevain | |
| D689,233 | S | 9/2013 | Boissevain | |
| 8,783,912 | B2 | 7/2014 | Yang | |
| 8,814,381 | B2 | 8/2014 | Ariyoshi | |
| D726,947 | S | 4/2015 | Boyer | |
| D736,984 | S | 8/2015 | Dal Ponte | |
| D742,577 | S | 11/2015 | Compton | |
| D749,256 | S | 2/2016 | Caton | |
| 2008/0101063 | A1* | 5/2008 | Koike | F21K 9/20 362/231 |
| 2010/0238671 | A1 | 9/2010 | Catone | |
| 2011/0013397 | A1 | 1/2011 | Catone | |
| 2011/0141728 | A1* | 6/2011 | Russello | F21V 3/00 362/235 |
| 2011/0254425 | A1 | 10/2011 | Huang | |
| 2012/0002419 | A1 | 1/2012 | Zaderej | |
| 2012/0153797 | A1 | 6/2012 | Chen | |
| 2012/0261105 | A1 | 10/2012 | Lin | |
| 2012/0262917 | A1* | 10/2012 | Courcelle | F21V 15/01 362/235 |
| 2013/0032322 | A1 | 2/2013 | Hsu | |
| 2013/0118725 | A1 | 5/2013 | Chen | |
| 2014/0347846 | A1 | 11/2014 | Ahn | |
| 2015/0345772 | A1 | 12/2015 | Duckworth | |
| 2016/0047538 | A1* | 2/2016 | Peck | F21V 23/009 362/249.02 |
| 2016/0201891 | A1* | 7/2016 | Wandrey | F21V 13/04 362/294 |

* cited by examiner

AREA LUMINAIRE

RELATED APPLICATION

This application is a divisional of U.S. application Ser. No. 15/065,360, filed Mar. 9, 2016, which is based on U.S. Provisional Application No. 62/155,156, filed Apr. 30, 2015, the disclosures of which are incorporated herein by reference in their entirety and to which priority is claimed.

FIELD

Various exemplary embodiments relate to light fixtures or luminaires, for example external area light fixtures designed to illuminate streets, paths, parking lots, or other areas.

BACKGROUND

Light fixtures, or luminaires, are used with electric light sources to provide an aesthetic and functional housing in both interior and exterior applications. One type of light fixture is an area light, generally used for exterior lighting of roads, walkways, parks, parking lots, or other large areas requiring a significant amount of lighting. Area lights typically include a light fixture attached to a pole, wall, or other elevated structure to provide an elevated lighting position. In recent years, lighting applications, including area lights have trended towards the use of light emitting diodes (LEDs) as a light source in place of conventional incandescent and fluorescent lamps.

SUMMARY

According to an exemplary embodiment, a luminaire includes a housing having a top wall and a sidewall. A first fin extends from the top wall and a second fin extends from the side wall. A light emitter assembly having a heat sink includes a third fin extending from the heat skink configured to mate with the first and second fins.

According to another exemplary embodiment, a luminaire includes a housing and a light emitter assembly. The housing has a top wall, a side wall, and a first mounting feature. The light emitter assembly has a second mounting feature configured to connect to the first mounting feature so that the light emitter can be selectively connected to the housing in multiple orientations.

According to another exemplary embodiment, a luminaire includes a housing having a first compartment for receiving a control component and a second compartment. A wall separates the first compartment and the second compartment. A mounting portion is positioned in the second compartment. A plurality of heat fins are in thermal communication with the mounting portion. A light emitter assembly is connected to the mounting portion.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
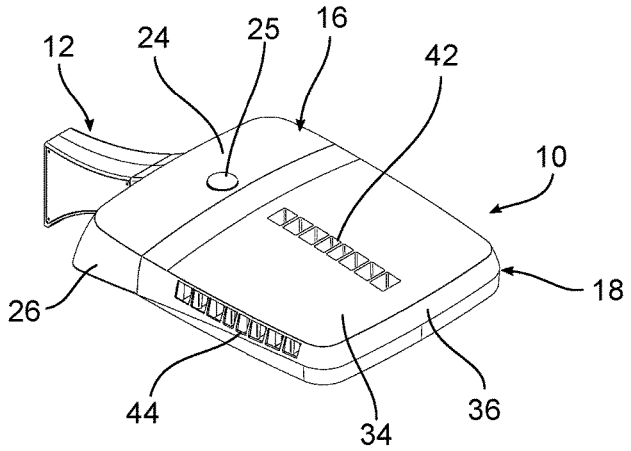
FIG. 1 is a top, front perspective view of an exemplary luminaire.
Figure 2:
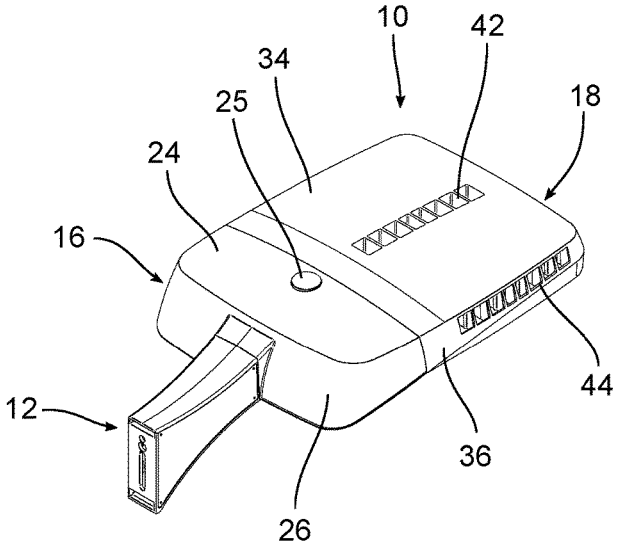
FIG. 2 is a top, rear perspective view of FIG. 1.
Figure 3:
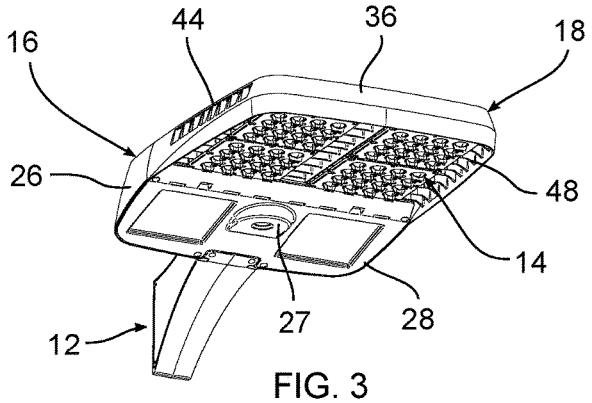
FIG. 3 is a bottom, front perspective view of FIG. 1.
Figure 4:
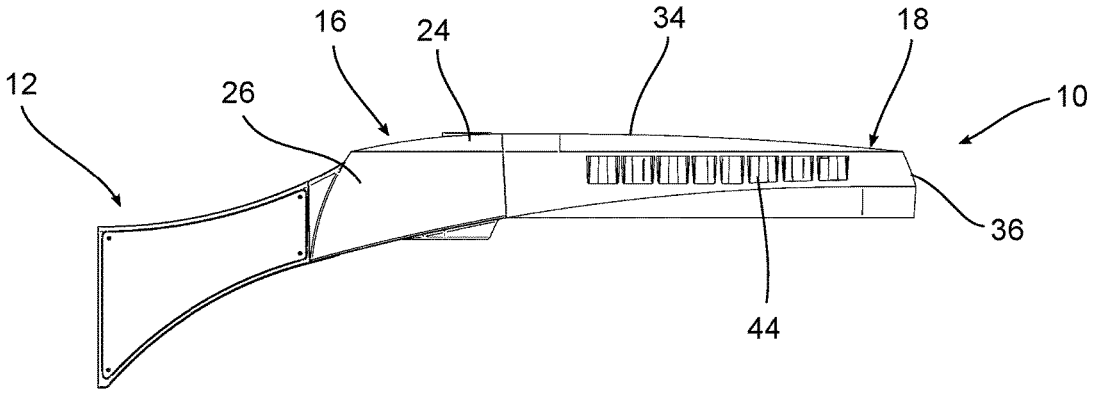
FIG. 4 is a left side view of FIG. 1.
Figure 5:
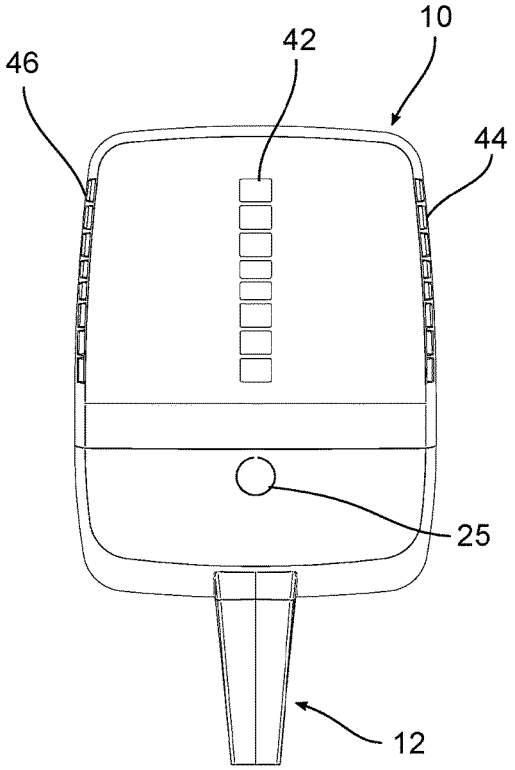
FIG. 5 is a top view of FIG. 1.
Figure 6:
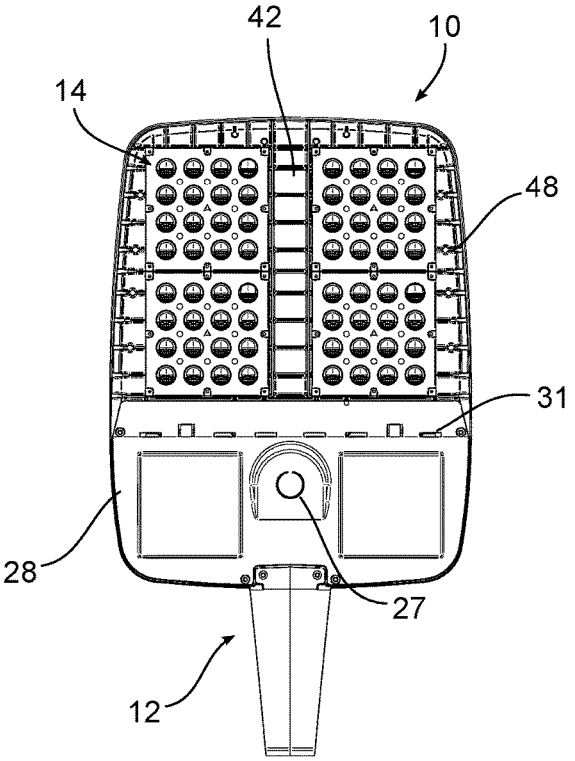
FIG. 6 is a bottom view of FIG. 1.

According to various exemplary embodiments, a luminaire includes a housing 10, an arm 12, and one or more light emitter assemblies connected to the housing. The housing includes a first compartment 16 and a second compartment 18. The arm 12 connects the housing 10 to a wall, post, or other support or structure to mount the luminaire over a given area. In an exemplary embodiment, the first compartment 16 includes one or more electronic components and the second compartment includes one or more light sources. For example, the first compartment 16 houses one or more drivers (not shown) and other necessary equipment to supply power to light emitters contained in or otherwise connected to the second compartment 18. The second compartment 18 can be configured to contain a variety of light emitters in different patterns based on the desired use and light output. The positions of the first and second compartments 16, 18 may vary as needed.

In various exemplary embodiments the housing 10 is made from aluminum, although other metal, polymer, or composite materials may also be used. The housing 10 may be integrally formed or formed in separate sections and attached to one another. A lens, diffuser, or other cover (not shown) may be connected to the housing positioned beneath the light emitters. The housing can have various shapes, sizes, and configurations as needed.

Figure 7:
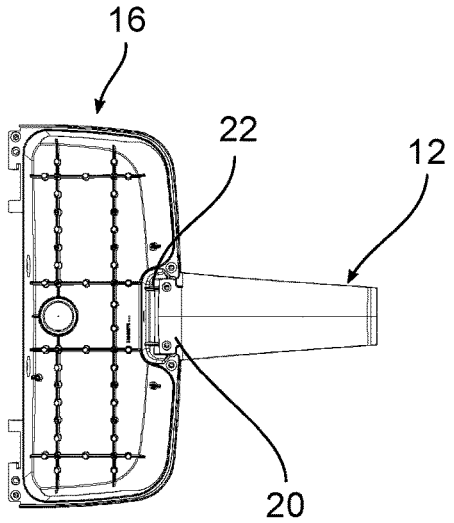
FIG. 7 is a bottom view of an exemplary arm and first compartment.
Figure 8:
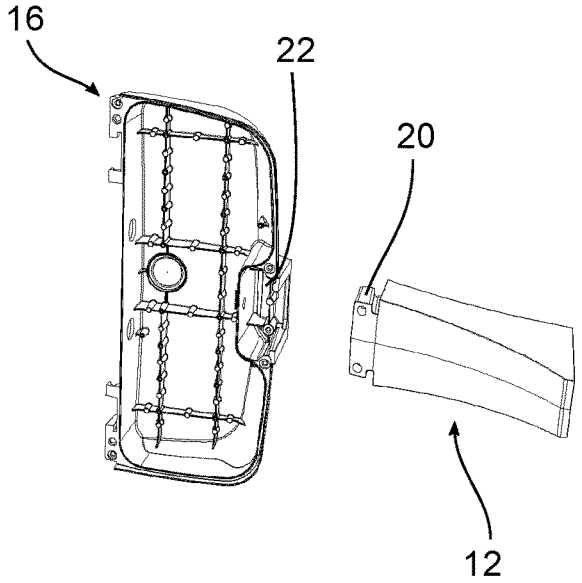
FIG. 8 is an exploded view of FIG. 7.

In an exemplary embodiment, the arm 12 is removably connected to the housing 10, as best shown in FIGS. 7 and 8. The arm 12 includes a first mounting component 20 that engages with a second mounting component 22 on the housing. The arm 12 is initially connected to a structure, for example by one or more fasteners. The housing 10 is then connected to the arm 12, eliminating the need to hold and manipulate the entire luminaire housing during the initial connection. In an exemplary embodiment, the arm 12 includes a projection that mates with a slot in the housing 10, so that the housing 10 can be slidably engaged with the arm 12. The housing 10 can then be furthered secured with fasteners. Other mounting connections can be used. The arm 12 can also include a removable panel that allows a user access to the interior of the arm, for example to access wiring.

Figure 9:
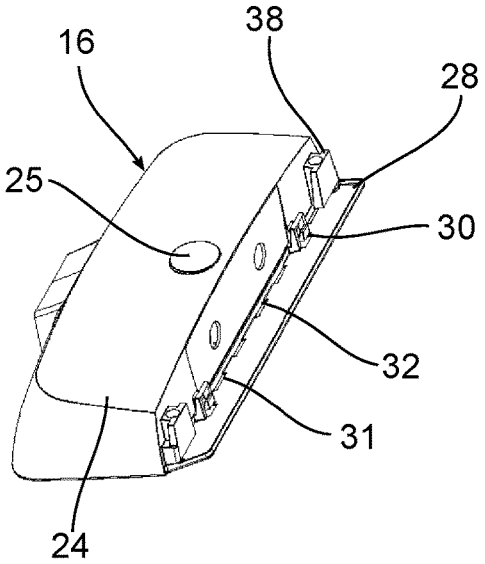
FIG. 9 is a top perspective view of the first compartment and an exemplary door.
Figure 10:
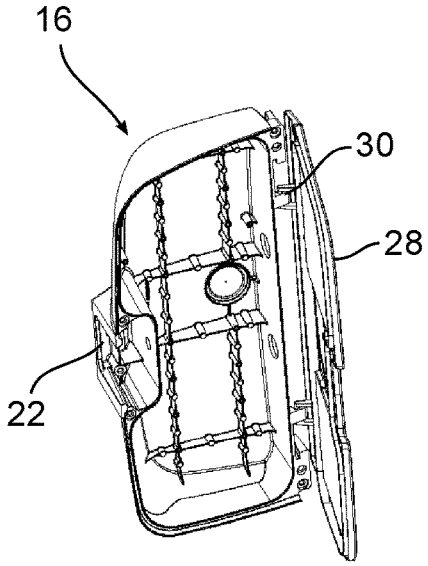
FIG. 10 is a bottom perspective view of FIG. 9 with the door in an open position.
Figure 11:
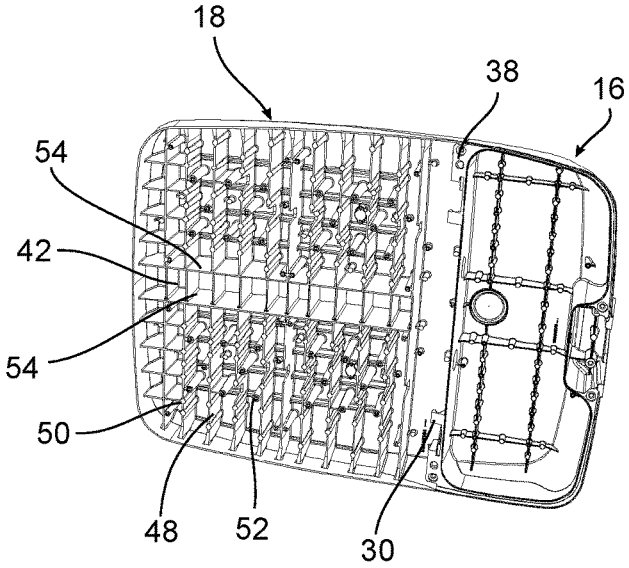
FIG. 11 is a bottom perspective view of the exemplary first and second compartments.

The first compartment 16 includes a top wall 24, a side wall 26 extending at least partially around the top wall 24, and a door 28. One or more fins can extend from the top wall 24 to transfer heat from the electronic components. A sensor 25, for example a photo controller, extends through the top wall 24. The door 28 is removeably connected to the housing 10, for example with fasteners, to provide access to the first compartment 16. The door 28 can also be pivotally connected to the first compartment 16 through a hinge member 30, as best shown in FIGS. 9 and 10. A recess 27 can optionally receive another sensor, for example an occupancy sensor or a camera. One or more gaskets can be used to seal a portion of the first compartment 16. A series of openings 31 can be provided, for example in the door 28, to allow fluid to pass through the housing 10.

The second compartment 18 includes a top wall 34, and a side wall 36 extending at least partially around the top wall 34 to define an interior. The top wall 34 is a substantially continuous structure, although different configurations may be used depending on the housing 10. In other exemplary embodiments different numbers of side walls 36 can be used, including a continuous side wall having a first side, a second side, and a front.

Figure 12:
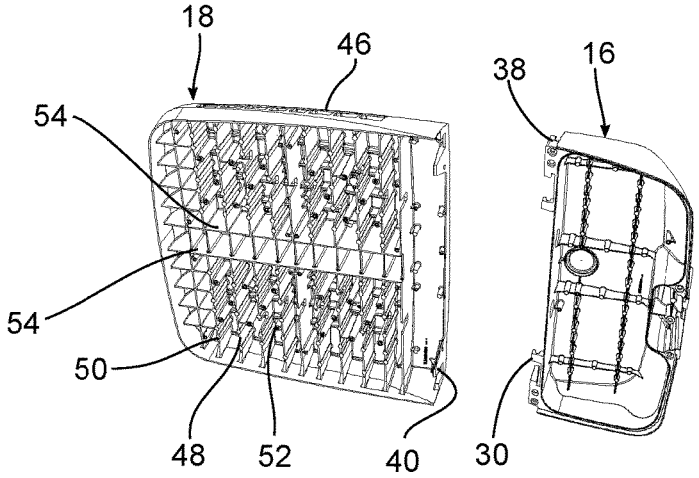
FIG. 12 is an exploded view of FIG. 11.
Figure 13:
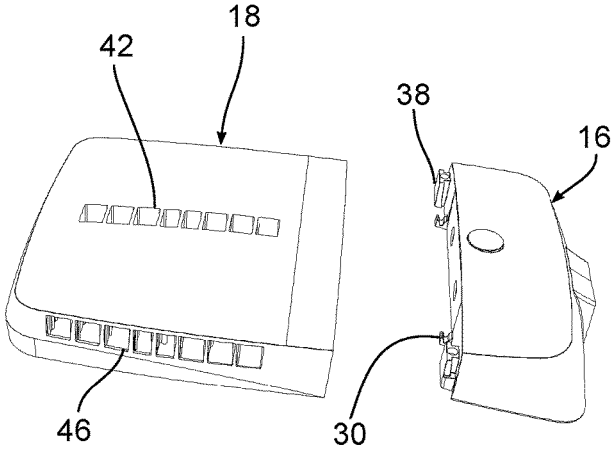
FIG. 13 is a top perspective view of FIG. 12.
Figure 14:
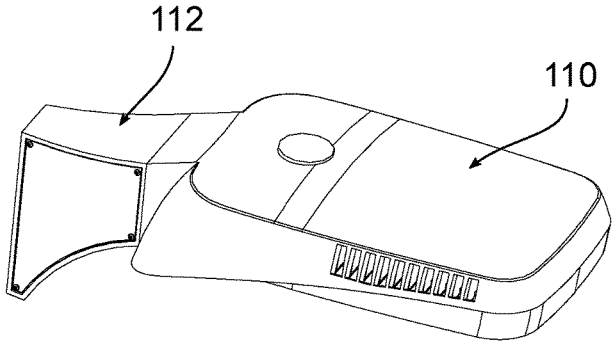
FIG. 14 is a top, front perspective view of another exemplary luminaire.
Figure 15:
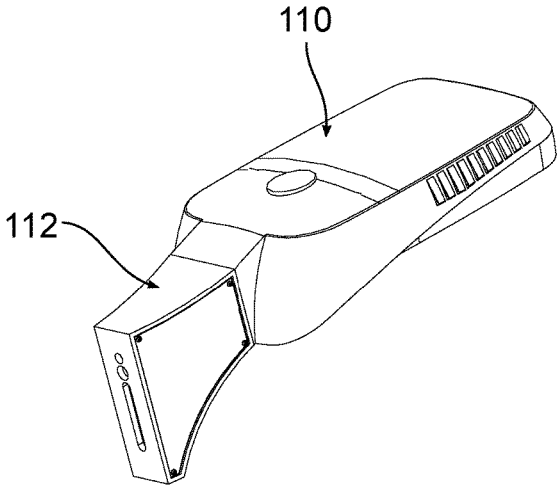
FIG. 15 is a top, rear perspective view of FIG. 14.
Figure 16:
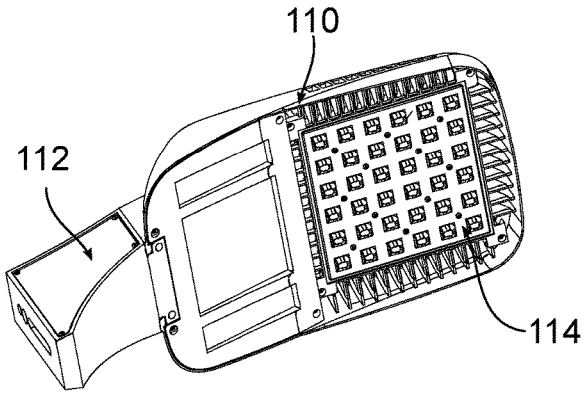
FIG. 16 is a bottom, side perspective view of FIG. 14.

As best shown in FIGS. 12 and 13, the first compartment 16 is connected to the second compartment 18, for example through corresponding first and second mounting features. In the illustrated exemplary embodiment, the first mounting feature 38 extends from the first compartment 16 and the second mounting feature 40 is positioned on the second compartment 18, although alternative configurations can be used.

A top opening 42 having a substantially rectangular shape extends through the top wall 24. The side wall 36 includes a first opening 44 on a first side and a second opening 46 on a second side. In the exemplary embodiment, the first and second openings 44, 46 extend through the side wall 36 to the interior and have a substantially rectangular shape. In alternative embodiments, the size, shape, and configuration of the top, first, and second openings 42, 44, 46 is varied depending on the housing 10, the light emitters, and the desired light output and performance of the luminaire.

In accordance with further exemplary embodiments, the interior of the second compartment includes a plurality of fins 48 spaced from one another. One or more fins 48 extend down from a bottom surface of the top wall 34, extending from the first side to the second side of the side wall 36. In various exemplary embodiments, the fins 48 can extend from the front to back or diagonally across the housing 10. The fins 48 are at least partially exposed to the outside of the second compartment 18 on the bottom and one or more of the fins 48 can be in communication with the top, first and second openings 42, 44, 46, for example in thermal and/or fluid communication. In an exemplary embodiment one or more of the fins 48 are exposed to the outside of the second compartment 18 on the top and the sides through the openings.

In various exemplary embodiments, the fins 48 are connected to the bottom surface of the top wall 34, spaced from the bottom surface of the top wall 34, or any combination thereof. One or more fins 48 include an embossed or enlarged portion 50. The fins 48 may be formed integrally with the second compartment 18 or formed separately and attached to the second compartment 18, for example through welding or fasteners. In various alternative embodiments, the size shape and configuration of the fins 48 can be varied depending on the housing 10 and the required heat dissipation. The fins 48 may also be adapted to be used with different housings and types of luminaires.

The second compartment 18 contains one or more light emitters. In the exemplary embodiment shown, the light emitters are a plurality of light emitting diode (LED) modules 14. The luminaire may utilize other light sources, for example other solid state, electrical filament, fluorescent, plasma, or gas light sources. In an exemplary embodiment, the LED modules 14 include an LED board having one or more LED light sources connected to a printed circuit board (PCB). The LED light sources can include a dome-shaped lens surrounding one or more light generating elements and necessary circuitry. Various types of LED modules 14 may be used depending on the performance requirements and the desired output as would be understood by one of ordinary skill in the art. According to an exemplary embodiment, an optic is positioned over each LED light source to direct or diffuse the emitted light. The optic extends through a bezel, for example a sheet metal enclosure at least partially enclosing the LED board. According to an exemplary embodiment, the bezel covers the bottom and sides of the LED board and has openings for the optics. The bezel can also cover the top of the LED board if required. The bezel also may be configured to seal the perimeter of the LED board. In certain exemplary embodiments, the bezel and the optics are sealed together, for example through adhesives or welding, such as ultrasonic welding, to form an integral unit. The various sizes and shapes of the PCB, as well as the various light sources, materials, and other configurations used in connection with the PCB, would be understood by one of ordinary skill in the art.

More than one LED module 14 can be used, for example front and rear right modules and front and rear left modules. The LED modules 14 may be arranged in different groupings and patterns depending on the housing and the desired light output. The LED modules 14 can have optics with light directing features that focus light in a uniform direction, for example toward the front of the housing. To modify the light output, the light modules can be removed and rotated so that the optics direct the light in a new direction. The exemplary, substantially square LED modules 14 shown can be adjusted ninety degrees at a time. Different shapes and configurations of LED modules 14 can allow for different rotation angles, for example a hexagonal LED module could be rotated sixty degrees.

According to various exemplary embodiments, the LED modules 14 are connected to the bottom surface of the fins 48, to the top or sides of the second compartment 18, or any combination thereof. The LED modules 14 are connected to the fins 48 or second compartment by mechanical fasteners, for example mounting screws or bolts, or other available mechanical or chemical connections. In an exemplary embodiment, one or more bosses 52 extend from the top wall and receive fasteners to connect the LED modules 14. According to various exemplary embodiments, the LED modules 14 are spaced so that at least a portion of the fins are exposed on the bottom. The fins are designed to dissipate heat from the LEDs and the configuration of the second compartment, fins, and LED modules 14 allows air to flow underneath of the housing 20, through the interior, and through the top, first, and second openings. In an exemplary embodiment, boundary walls 54 are positioned between the LED modules 14 and the top openings. The boundary wall 54 helps separate the LED modules 14 from the openings and provide protection from elements such as dirt or other debris and water. The boundary wall 54 can extend all the way to the top wall 34, or a top edge of the boundary wall 54 can be spaced from the top wall 34 to increased airflow around the LED modules 14. The exact height of the boundary wall 54 can be varied depending on the application.

FIGS. 14-25 show another exemplary embodiment of a luminaire. According to various exemplary embodiments, the luminaire includes a housing no, an arm 112, and one or more light modules 114. The housing no includes a top wall and one or more side walls. The exemplary embodiment shows a single, continuous side wall having various curvilinear and rectilinear sections, although other configurations can be used. The top wall and the side wall at least partially enclose a first compartment 116 and a second compartment 118. The arm 112 connects the housing no to a wall, post, or other support or structure so that the luminaire can direct light to a given area. In an exemplary embodiment, the first compartment 116 includes one or more control components and the second compartment 118 includes one or more light sources. For example, the first compartment 116 houses one or more drivers, sensors, such as photo-sensors and occupancy sensors, and/or communication devices (not shown) and/or other necessary equipment to supply power to or and control light emitters contained in or otherwise connected to the second compartment 118. The second compartment 118 can be configured to contain a variety of light emitters in different patterns based on the desired use and light output. The positions of the first and second compartments 116, 118 may vary as needed.

In various exemplary embodiments the housing no is made from aluminum, although other metal, polymer, or composite materials may also be used. The housing 110 may be integrally formed or formed in separate sections and attached to one another. A lens, diffuser, or other cover (not shown) may be connected to the housing positioned beneath the light emitters. The housing 110 can have various shapes, sizes, and configurations as needed.

In an exemplary embodiment, the arm 112 is removably connected to the housing 110. The arm 112 includes a first mounting component that engages with a second mounting component on the housing 110. The arm 112 is initially connected to a structure, for example by one or more fasteners. The arm 112 includes one or more rear openings to connect to receive fasteners or other mounting components. An elongated slot allows the arm 112 to be connected to structures having different mounting points.

Figure 17:
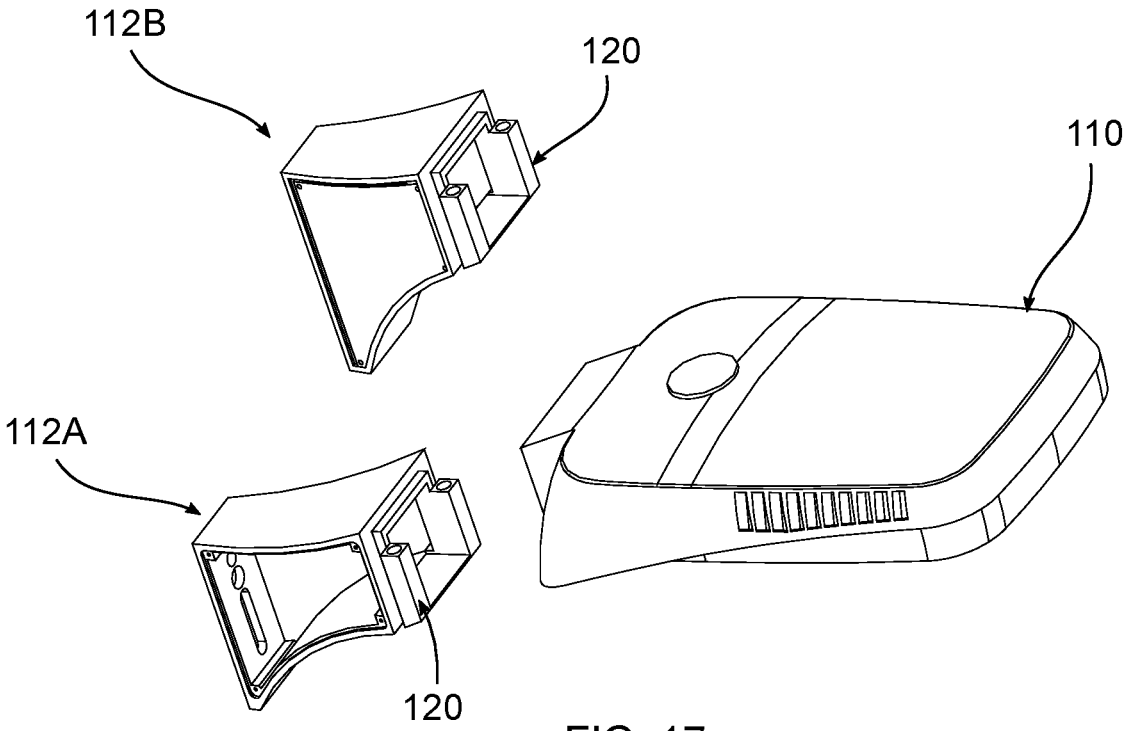
FIG. 17 is a top perspective, exploded view of a housing and a first and second arm.
Figure 18:
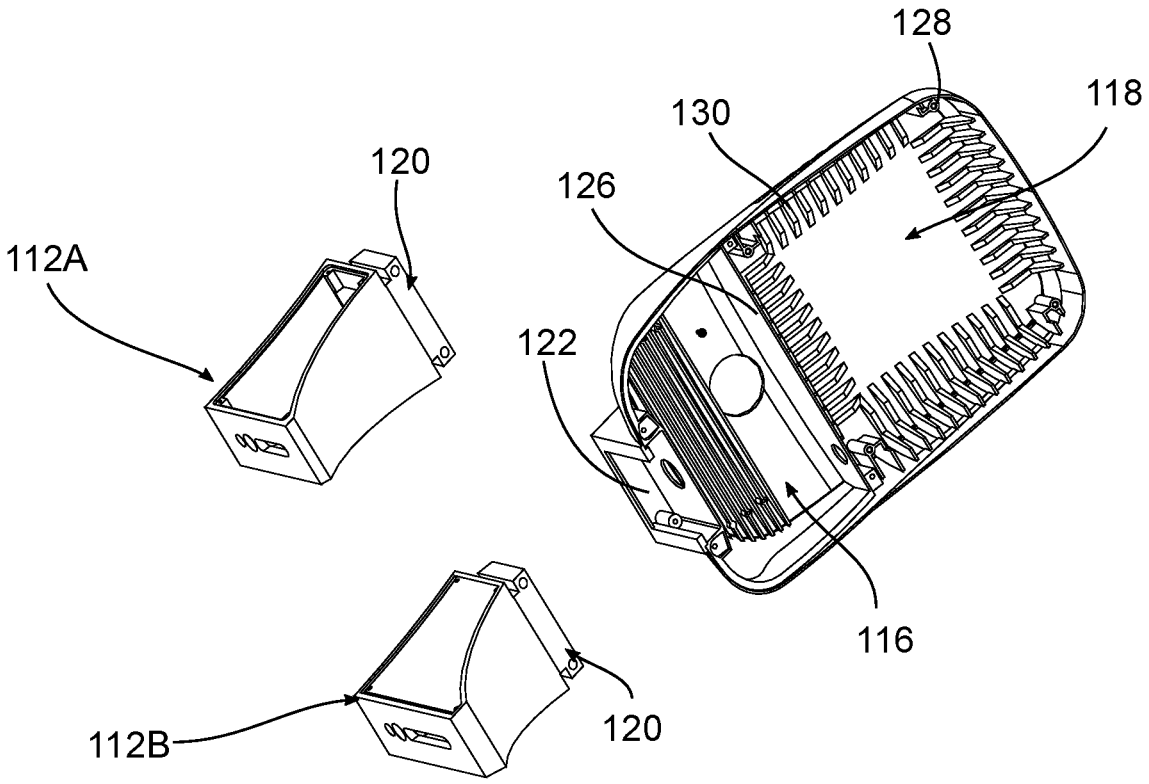
FIG. 18 is a bottom perspective view of FIG. 17.

After the arm 112 is connected to the structure, the housing 110 is connected to the arm 112, eliminating the need to hold and manipulate the entire luminaire during the initial connection. In an exemplary embodiment, the arm 112 includes a projection 120 that mates with a slot 122 in the housing 110, so that the housing no can be slidably engaged with the arm 112. The projection 120 can have a substantially T-shaped cross section. The projection includes one or more posts, having openings to receive fasteners that further secure the housing 110 to the arm 112. The slot 122 in the housing has a shape corresponding to the projection 120 and can include bosses to receive the fasteners. Other mounting connections can be used. FIGS. 17 and 18 show two different sized arms 112A, 112B, that can be connected to the housing 110. Arm 112A is shown with a panel removed to allow access to an interior compartment. The interior compartment can contain wiring connected during installation to provide power to the luminaire. The panel can be connected to the arm 112A as needed, for example with fasteners.

FIG. 18 shows an exemplary embodiment of the first compartment 116 without any control components. The top wall of the housing can include an opening allowing a sensor to pass from the first compartment through the housing 110, for example a photo controller. The first compartment 116 can include one or more heat fins to draw heat from the control components to the housing. In an exemplary embodiment, a door 124 is removably and/or pivotably positioned over the first compartment 116. The door 124 is removeably connected to the housing, for example with fasteners, to provide access to the first compartment 116. One or more gaskets can be used to seal a portion of the first compartment 116.

A barrier 126 separates the first compartment 116 and the second compartment 118 and includes an opening to allow one or more conductors to pass from the first compartment 116 to the second compartment 118 and electrically and/or operably connect the control components to the light emitters.

The second compartment 118 receives one or more light emitters, for example a light module 114. As best shown in FIG. 18, the second compartment 118 can include a mounting feature, for example one or more bosses 128 for receiving fasteners. One or more fins 130 are positioned in the second compartment 118 to conduct heat to the housing 110. The exemplary embodiment shows four sets of fins 130, with a front set, a rear set, and two side sets. Different numbers of fins 130 and different orientations and placements can be used depending on the thermal needs, configuration of the light assembly, and the configuration of the housing 110. The fins 130 have a first section that is connected to or adjacent the top wall and a second section that is connected to or adjacent the side wall. In an exemplary embodiment, the first section has an angled portion and a substantially horizontal portion and the second section has an angled portion. Different sizes, shapes, and configurations of the fins 130 can also be used.

Figure 19:
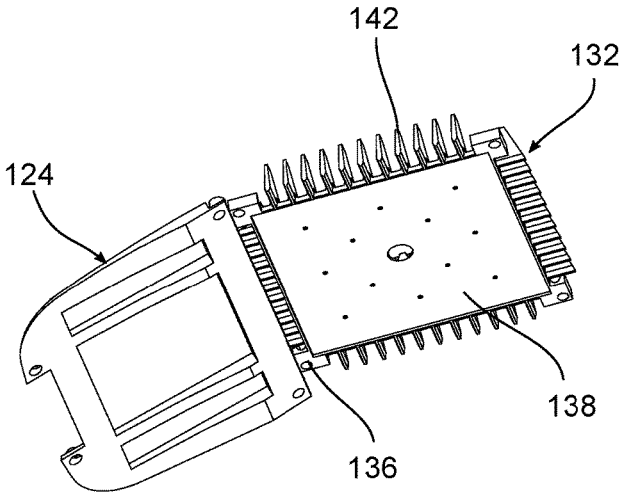
FIG. 19 is a bottom perspective view of an exemplary door and heat sink.
Figure 20:
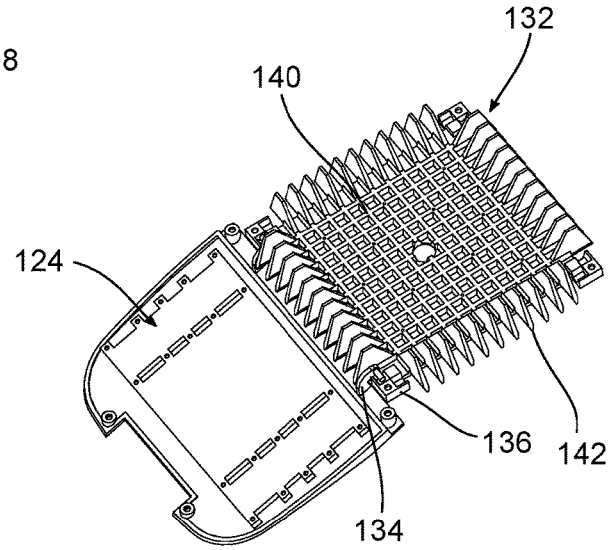
FIG. 20 is a top perspective view of FIG. 19.
Figure 21:
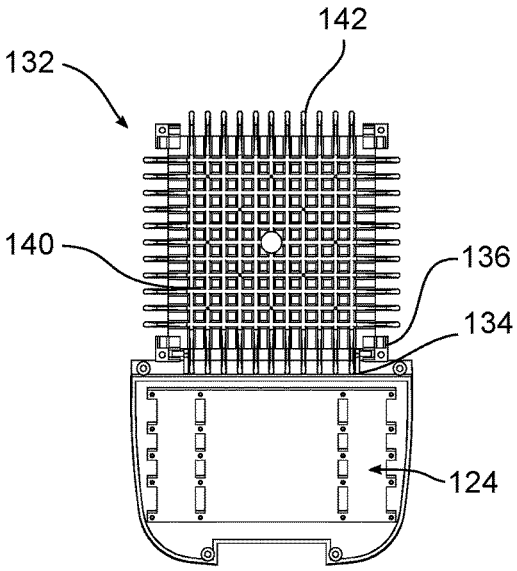
FIG. 21 is a top view of FIG. 19.

FIGS. 19-21 show an exemplary embodiment of a door 124 that can be positioned over the first compartment 116 and a heat sink 132 that can be positioned in the second compartment 118. The door 124 includes one or more openings and bosses that receive fasteners to connect to the first compartment 116. The door 124 can also include mounting structure to connect control components, for example drivers. A first hinge member 134 on the door 124 is connected to a second hinge member 136 on the heat sink 132. The first hinge member 134 includes an arm and a pin extending from the arm that pivotably connects the door 124. This connection provides access to the first compartment 116 without complete removal of the door 124. The second hinge members 136 include one or more bearing surfaces that receive the pin. In the exemplary embodiment shown, the heat sink 132 includes a pair of bearing surfaces at each corner, allowing the heat sink 132 to be connected at any orientation and pivotally receive the door 124.

The heat sink 132 includes a mounting portion 138, a top portion 140, and one or more fins 142. The mounting portion 138 receives the light assembly 114, for example connected by one or more fasteners. The top portion 140 includes a grid structure to help draw heat from the light assembly 114. The heat sink 132 can also include a mounting feature for connecting the heat sink 132 to the housing no. The fins 142 are positioned along the outer edge of the heat sink 132. The exemplary embodiment shows four sets of fins 142, with a front set, a rear set, and two side sets. Different numbers of fins 142 and different orientations and placements can be used depending on the needs and configuration of the light assembly and the configuration of the housing.

Figure 22:
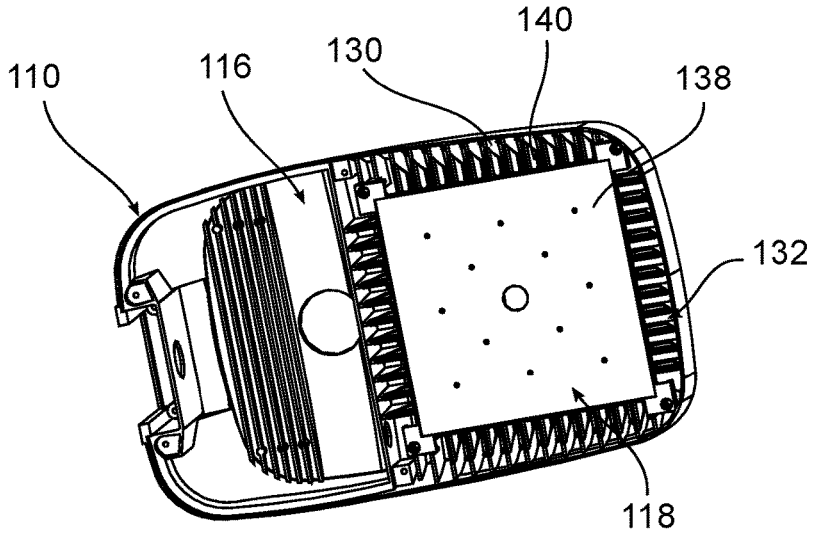
FIG. 22 is a bottom perspective view of the exemplary housing and heat sink.
Figure 23:
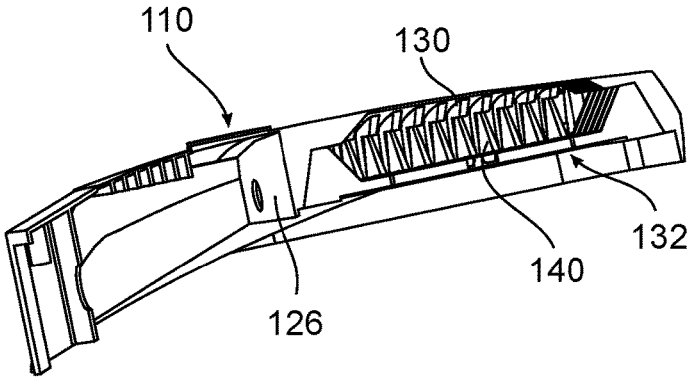
FIG. 23 is a first sectional view of FIG. 22.
Figure 24:
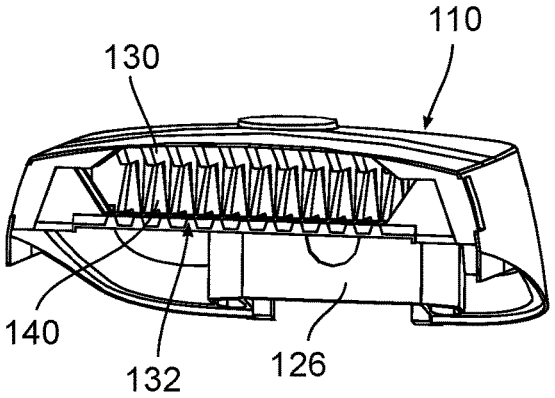
FIG. 24 is a second sectional view of FIG. 22.

In an exemplary embodiment, the heat sink fins 142 are configured to mate or nest with the second compartment fins 130. The heat sink fins 142 have a substantially trapezoidal shape with angled sides and a horizontal top portion. As best shown in FIGS. 22-24, the angled sides of the heat sink fins 140 align with the angled sides of the second compartment fins 130 and the top portion of the heat sink fins 140 align with the horizontal portion of the second compartment fins 130. The two sets of fins can be touching or spaced apart and can be thermally connected in either configuration.

Figure 25:
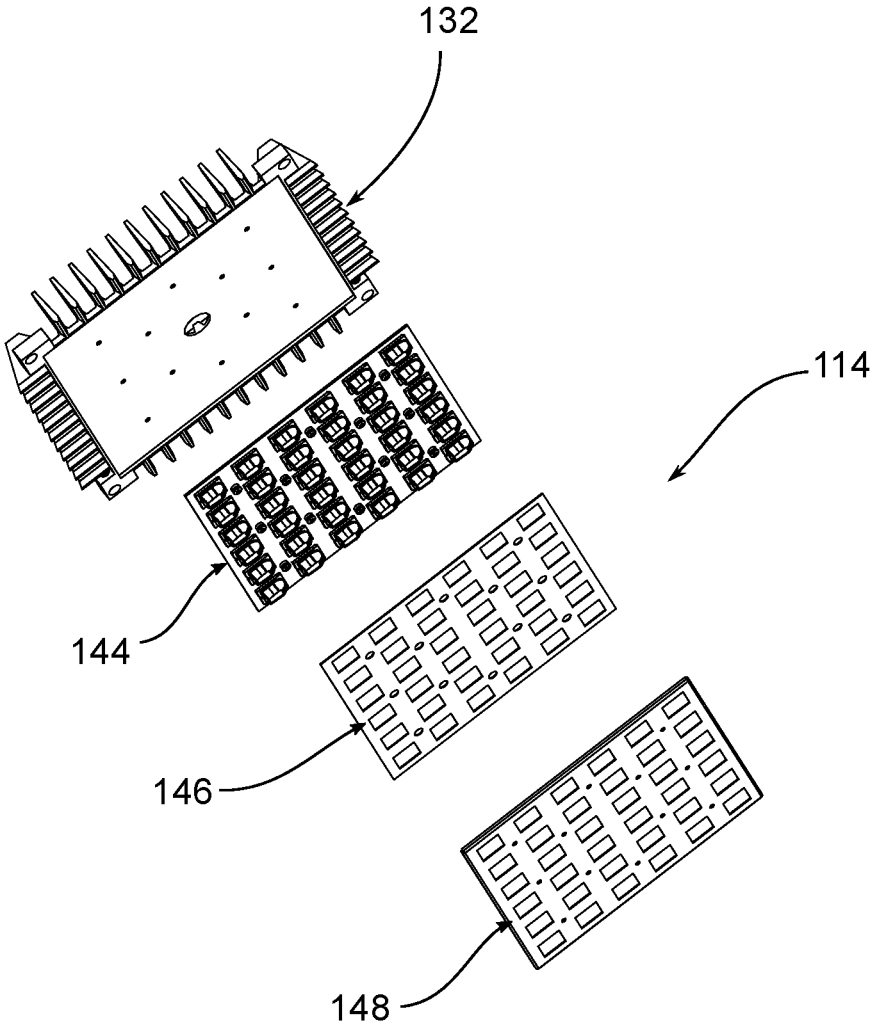
FIG. 25 is an exploded view of the exemplary heat sink and light emitter assembly.
Figure 26:
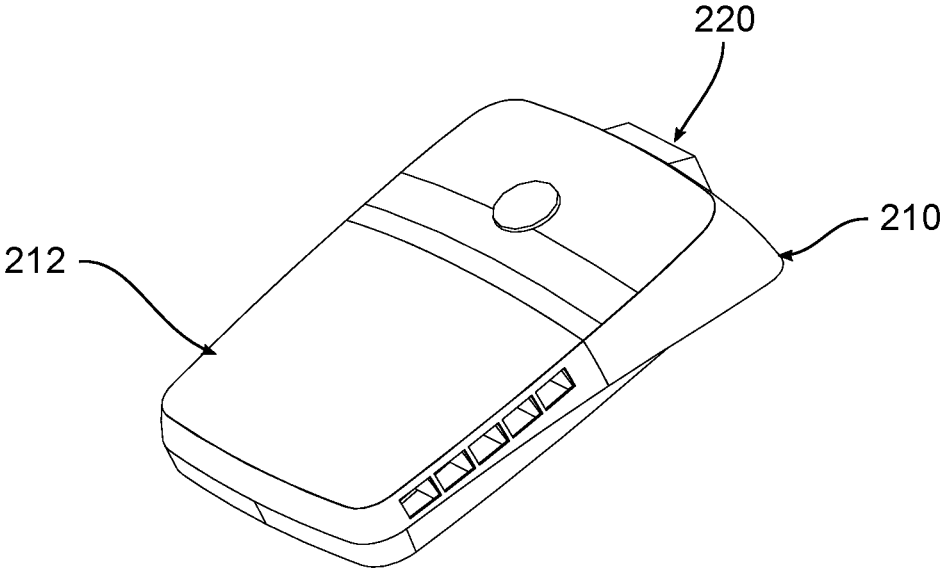
FIG. 26 is a top, front perspective view of another exemplary luminaire.
Figure 27:
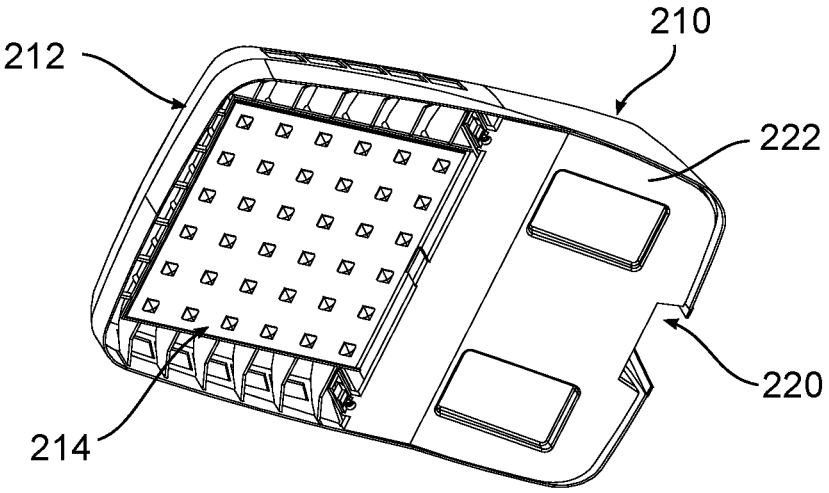
FIG. 27 is a bottom, side perspective view of FIG. 26.
Figure 28:
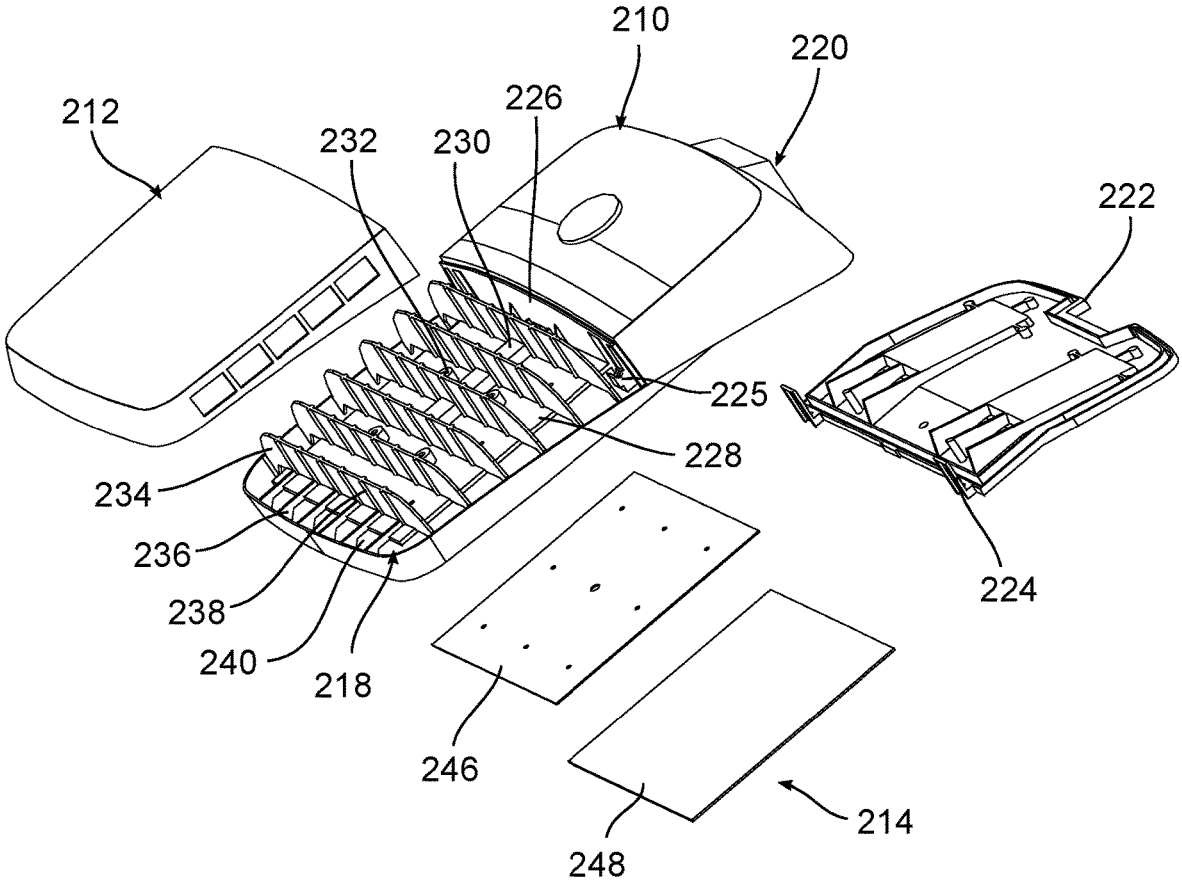
FIG. 28 is a top perspective, exploded view of FIG. 26.

FIG. 25 shows an exemplary embodiment of a light emitter assembly, for example the heat sink 132 and the light module 114. The light module 114 includes an LED board 144, a gasket 146, and a bezel 148. The LED board 144 includes a circuit board and one or more LEDs connected to the circuit board. Various types of LEDs may be used depending on the performance requirements and the desired output as would be understood by one of ordinary skill in the art. According to an exemplary embodiment, an optic is positioned over each LED to direct or diffuse the emitted light. The optic extends through a gasket 146 and a bezel 148, for example a sheet metal enclosure at least partially enclosing the LED board 144. The gasket 146 provides protection and helps to seal the LED board 144. According to an exemplary embodiment, the bezel 148 covers the bottom and sides of the LED board 144 and has openings for the optics. The bezel 148 can also cover the top of the LED board 144 if required. The bezel 148 also may be configured to seal the perimeter of the LED board 144. In certain exemplary embodiments, the bezel 148 and the optics are sealed together, for example through adhesives or welding, such as ultrasonic welding, to form an integral unit. The various sizes and shapes of the LED board 144, as well as the various light sources, materials, and other configurations used in connection with the LED board 144, as would be understood by one of ordinary skill in the art. The luminaire may utilize other light sources, for example other solid state, electrical filament, fluorescent, plasma, or gas light sources.

The light module 114 can include optics with light directing features that focus light in a uniform direction, for example toward the front of the housing. To modify the light output, the combination of the heat sink 132 and the light module 114 can be removed and rotated so that the optics direct the light in a new direction. The exemplary, substantially square LED assembly shown can be adjusted ninety degrees at a time. Different shapes and configurations of LED modules can allow for different rotation angles, for example a hexagonal LED module could be rotated sixty degrees.

FIGS. 26-32 show another exemplary embodiment of a luminaire. According to various exemplary embodiments, the luminaire includes a housing 210, a cover 212, and one or more light modules 214. The housing 210 and the cover 212 include a top wall and one or more side walls having various curvilinear and rectilinear sections that connect, although other configurations can be used. The housing 210 includes a first compartment 216 and a second compartment acting as a light emitter section 218. The rear of the housing include a mounting component 220 for connecting to an arm 112 or other support or structure so that the luminaire can direct light to a given area. In an exemplary embodiment, the compartment 216 includes one or more control components. For example, the compartment 216 houses one or more drivers, sensors, such as photo-sensors and occupancy sensors, and/or communication devices (not shown) and/or other necessary equipment to supply power to or and control light emitters contained in or otherwise connected to the light emitter section 218. The light emitter section 218 can be configured to contain a variety of light emitters in different patterns based on the desired use and light output.

In various exemplary embodiments the housing 210 and the cover 212 are made from aluminum, although other metal, polymer, or composite materials may also be used. The housing 210 may be integrally formed or formed in separate sections and attached to one another. A lens, diffuser, or other cover (not shown) may be connected to the housing positioned beneath the light emitters. The housing 210 can have various shapes, sizes, and configurations as needed.

In various exemplary embodiments, a door 222 is removably and/or pivotably positioned over the compartment 216. The door 222 includes one or more first hinge members 224 that can connect to a second hinge member 225 on the housing 210. This connection provides access to the compartment 216 without complete removal of the door 222. The first hinge member 224 includes a pin extending between a pair of supports. The second hinge member 25 includes one or more bearing surfaces that receive the pin. One or more fasteners can be used to secure the door 222 to the housing 210 in a closed position. The door 222 can also include mounting structure to connect control components, for example drivers.

Figure 29:
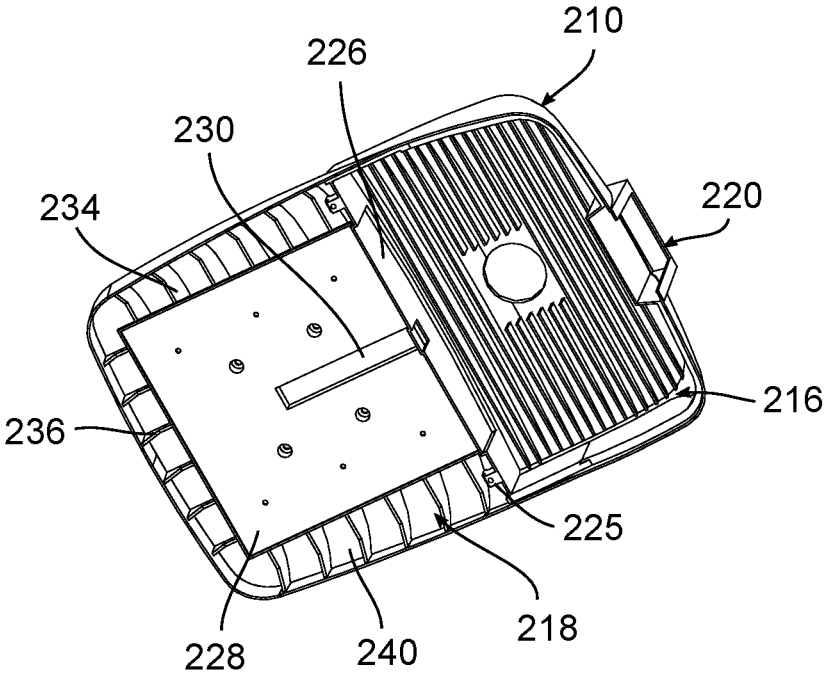
FIG. 29 is a bottom perspective view of the housing of FIG. 26.
Figure 30:
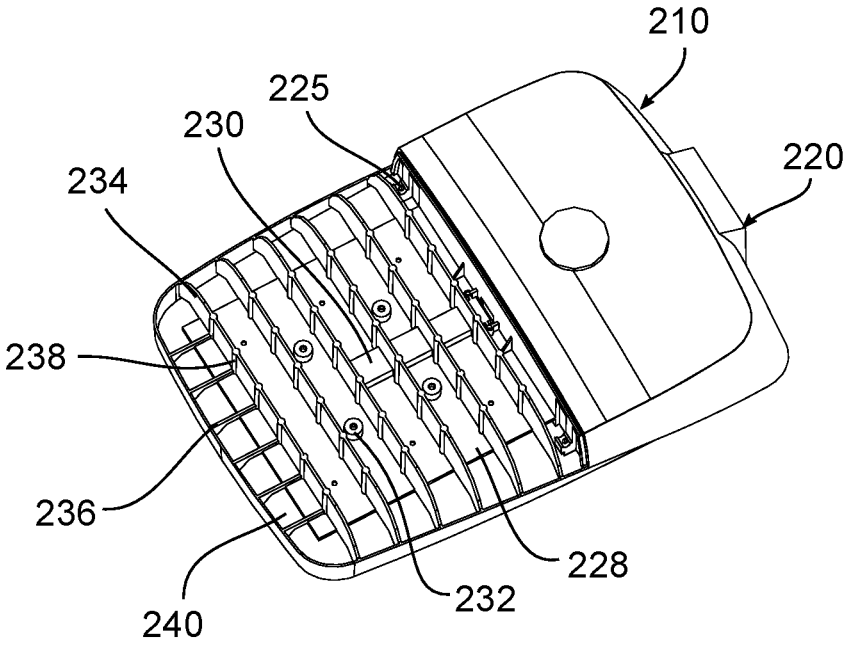
FIG. 30 is a top perspective view of the housing of FIG. 26.

FIGS. 29 and 30 show the housing 210 with the cover 212 removed and without any control components. The top wall of the housing 210 can include an opening allowing a sensor to pass from the compartment 216 through the housing 210, for example a photo controller. The compartment 216 can include one or more heat fins to draw heat from the control components to the housing 210. In an exemplary embodiment, A barrier 226 separates the compartment 216 and the light emitter section 218. An opening allows one or more conductors to pass from the compartment 216 to the light emitter section 118 and electrically and/or operably connect the control components to the light emitters. The opening can receive or be aligned with a gasket or conduit that extends into the light emitter section 118.

The light emitter section 218 receives one or more light emitters, for example a light module 214. A mounting portion 228 extends from the barrier 226. In an exemplary embodiment, the mounting portion 228 includes one or more openings to receive a fastener or fasteners to connect the light module 214. A recessed channel 230 extends from the opening in the barrier 226 to act as a conductor passage. A gasket or conduit can be positioned in the channel 230, for example a hollow silicone conduit having a rectangular cross-section.

According to various exemplary embodiments, one or more bosses 232 and one or more fins extend from the top of the mounting portion 228, as best shown in FIG. 30. In the exemplary embodiment shown, a plurality of first fins 234 extend across the width of the light emitter section 218 and connect to outer side edges of the housing 210 and a plurality of second fins 236 extend from the front edge of the housing to the mounting portion 228 substantially perpendicular to the first fins 234. The first fins 234 include one or more embossed or enlarged portions 238. The first and second fins 234, 236 extend across and divide openings 240 between the edges of the housing 210 and the mounting portion 228 to increase the flow of air and heat transfer from the light emitters. Alternative configurations can include different sizes and shapes of openings 240 or increase, reduce, or eliminate the number of openings 240. Different sizes, shapes, and numbers of fins 234, 236 and different orientations and placements can be used depending on the thermal needs, configuration of the light assembly, and the configuration of the housing 210.

Figure 31:
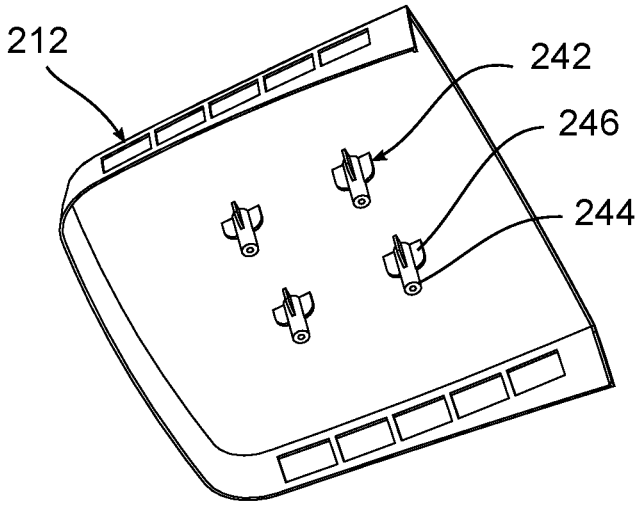
FIG. 31 is a bottom perspective view of the cover of FIG. 26.
Figure 32:
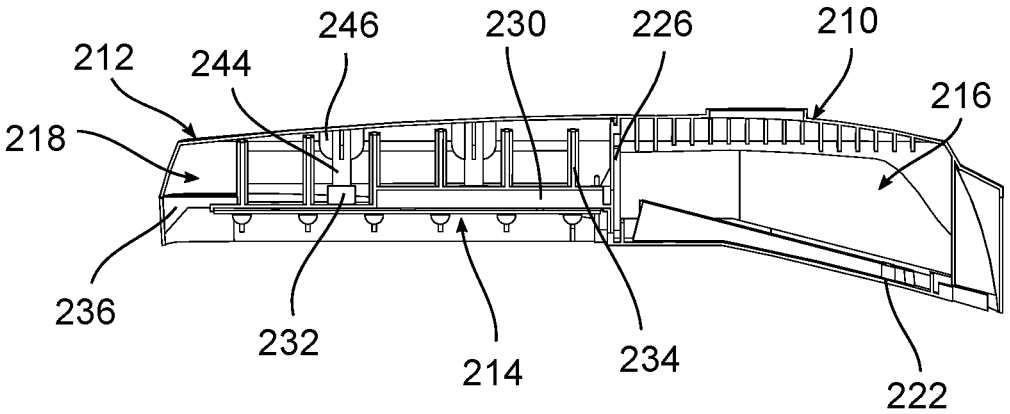
FIG. 32 is a side, sectional view of FIG. 26.

As best shown in FIGS. 31 and 32, the cover 212 includes one or more projections 242 extending toward the mounting portion 228. The projections 242 include a mounting post 244 and one or more fins 246 extending from the mounting post. The projections 242 can align with the bosses 232 on the mounting portion 228 so that a fastener can extend through the mounting portion 228 and connect the cover 212. As shown in FIG. 32, when the cover is connected to the mounting portion 228, a top or upward facing edge of the first fins 234 are spaced below a bottom surface of the cover 212 to increase airflow.

The light module 214 includes an LED board 246 and an optic 248. The LED board 246 includes a circuit board and one or more LEDs connected to the circuit board. Various types of LEDs may be used depending on the performance requirements and the desired output as would be understood by one of ordinary skill in the art.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a housing having a top wall and a side wall defining an interior cavity, and a first mounting feature extending from the top wall into the interior cavity; and a light emitter assembly having a second mounting feature configured to connect to the first mounting feature so that the light emitter can be selectively connected to the housing in multiple orientations inside of the interior cavity, wherein the light emitter assembly includes an LED board, a gasket, a bezel, and one or more optics connected to a heat sink.

2. The luminaire of claim 1, wherein the light emitter assembly includes a heat sink containing the second mounting feature.

3. The luminaire of claim 2, wherein the housing includes a first heat fin and the heat sink includes a second heat fin configured to nest with the first heat fin.

4. The luminaire of claim 1, wherein the light emitter assembly can be rotated in increments of 90 degrees.

5. The luminaire of claim 1, wherein the first mounting feature includes bosses for receiving a fastener.

6. The luminaire of claim 1, wherein the optics extend through the gasket and the bezel.

7. The luminaire of claim 1, wherein the orientation of the light emitter assembly can be changed without removing the LED board, the gasket, the bezel, and the optics from the heat sink.

8. The luminaire of claim 1, further comprising an arm removably connected to the housing.

9. A luminaire comprising:

a housing having a first compartment for receiving a control component and a second compartment;

a wall separating the first compartment and the second compartment;

a door pivotally connected to the housing to selectively cover the first compartment;

a mounting portion positioned in the second compartment;

a plurality of heat fins in thermal communication with the mounting portion; and a light emitter assembly connected to the mounting portion, wherein openings are provided between the mounting portion and an edge of the housing and one or more of the heat fins extend over the openings and connect to the edge.

10. The luminaire of claim 9, wherein one or more of the heat fins extend below the mounting portion.

11. The luminaire of claim 9, further comprising a cover connected to the housing and positioned over the second compartment.

12. The luminaire of claim 11, wherein a boss extends from the mounting portion and a projection extends from the cover aligned with the boss.

13. The luminaire of claim 12, wherein the projection includes a heat fin.

14. The luminaire of claim 13, wherein the mounting portion includes a channel.

15. A luminaire comprising:

a housing having a first compartment for receiving a control component and a second compartment;

a wall separating the first compartment and the second compartment;

a mounting portion positioned in the second compartment;

a boss extending from the mounting portion a plurality of heat fins in thermal communication with the mounting portion;

a light emitter assembly connected to the mounting portion; and a cover connected to the housing and positioned over the second compartment, wherein a projection extends from the cover aligned with the boss.

16. The luminaire of claim 15, wherein openings are provided between the mounting portion and an edge of the housing and one or more of the heat fins extend over the openings an connect to the edge.

17. The luminaire of claim 15, wherein the projection includes a heat fin.

18. The luminaire of claim 15, wherein the mounting portion includes a channel.

19. The luminaire of claim 15, further comprising an arm removably connected to the housing.

20. The luminaire of claim 1, wherein the housing includes a compartment separated from the interior cavity by a wall, wherein a control component is positioned in the compartment, wherein a channel extends between the wall and the light emitter assembly, and wherein a conductor passes through the channel to operably connect the light emitter assembly to the control component.

* * * * *